US008894104B2

(12) United States Patent
Yokomori et al.

(10) Patent No.: US 8,894,104 B2
(45) Date of Patent: Nov. 25, 2014

(54) DOOR CLOSER DEVICE

(71) Applicant: Mitsui Kinzoku Act Corporation, Kanagawa (JP)

(72) Inventors: Kazuhito Yokomori, Kanagawa (JP); Kohei Yamashita, Kanagawa (JP)

(73) Assignee: Mitsui Kinzoku Act Corporation (JP)

( * ) Notice: Subject to any disclaimer, the term of this patent is extended or adjusted under 35 U.S.C. 154(b) by 114 days.

(21) Appl. No.: 13/847,936

(22) Filed: Mar. 20, 2013

(65) Prior Publication Data

US 2013/0249222 A1 Sep. 26, 2013

(30) Foreign Application Priority Data

Mar. 26, 2012 (JP) ..... 2012-070379
Mar. 26, 2012 (JP) ..... 2012-070380

(51) Int. Cl.
*E05C 3/06* (2006.01)
*E05B 81/38* (2014.01)
*E05B 81/20* (2014.01)

(52) U.S. Cl.
CPC ..... *E05B 81/38* (2013.01); *E05B 81/20* (2013.01); *Y10S 292/23* (2013.01); *Y10S 292/46* (2013.01)
USPC .... 292/201; 292/216; 292/199; 292/DIG. 23; 292/DIG. 46

(58) Field of Classification Search
USPC ..... 292/199, 201, 216, DIG. 23, DIG. 46
See application file for complete search history.

(56) References Cited

U.S. PATENT DOCUMENTS 8,033,584 B2 * 10/2011 Akizuki et al. ..... 292/216

FOREIGN PATENT DOCUMENTS

JP 2007-138530 6/2007

* cited by examiner

*Primary Examiner* — Kristina Fulton
*Assistant Examiner* — Christine M Mills
(74) *Attorney, Agent, or Firm* — Skinner and Associates; Joel Skinner

(57) ABSTRACT

A door closer device comprises a sun gear pivotally mounted via a pivot shaft, a planetary gear which meshes with the sun gear to orbit the sun gear while turning on its own axis, a closing lever pivotally mounted via the pivot shaft and pivotally mounted with the planetary gear, and a sector gear which has an external teeth meshing with an output gear and an internal teeth meshing with the planetary gear. The closing lever swings about the pivot shaft to allow a latch to move from a half-latch position to a full-latch position where the latch fully engages with a striker.

8 Claims, 15 Drawing Sheets

DOOR CLOSER DEVICE

BACKGROUND OF THE INVENTION

The present invention relates to a door closer device for a vehicle in which a latch is moved from a half-latch position to a full-latch position.

JP2007-138530A discloses a vehicle door closer device.

The door closer device comprises a drive gear fixed to a rotary shaft of an electric motor; a sun gear having a gear portion which meshes with the drive gear; a ring gear which has an engagement portion on the outer circumferential surface and pivots concentrically with the sun gear, the ring gear engaging with an engagement member of the engagement portion not to rotate and disengaging the engagement member to rotate; a planetary gear which meshes with the sun gear and ring gear; a carrier which pivots concentrically with the sun gear and is coupled to the planetary gear, the carrier supplying rotational force by rotation and orbital motion of the planetary gear to the ring gear which is provided not to rotate by the engagement member with rotation of the sun gear; and a planetary gear mechanism including a drive lever which rotates together with the carrier. Rotational force from the carrier is transmitted to a latch of a latch mechanism which can hold a door in an improperly-closed state and a fully-closed state to move the latch from a half-latch position to a full-latch position allowing the door to close fully.

However, in the door closer device, in order to transmit rotational force of the electric motor to the sun gear, the sun gear is cylindrical and comprises a complicated structure which holds the ring gear, and the sun gear and ring gear comprise a disc which has a gear teeth on the circumference and become larger, so that the device itself becomes larger.

SUMMARY OF THE INVENTION

In view of the disadvantages, it is an object of the present invention to provide a door closer device that becomes smaller.

DETAILED DESCRIPTION OF PREFERRED EMBODIMENT

One embodiment of the present invention will be described with respect to the drawings.

Figure 1:
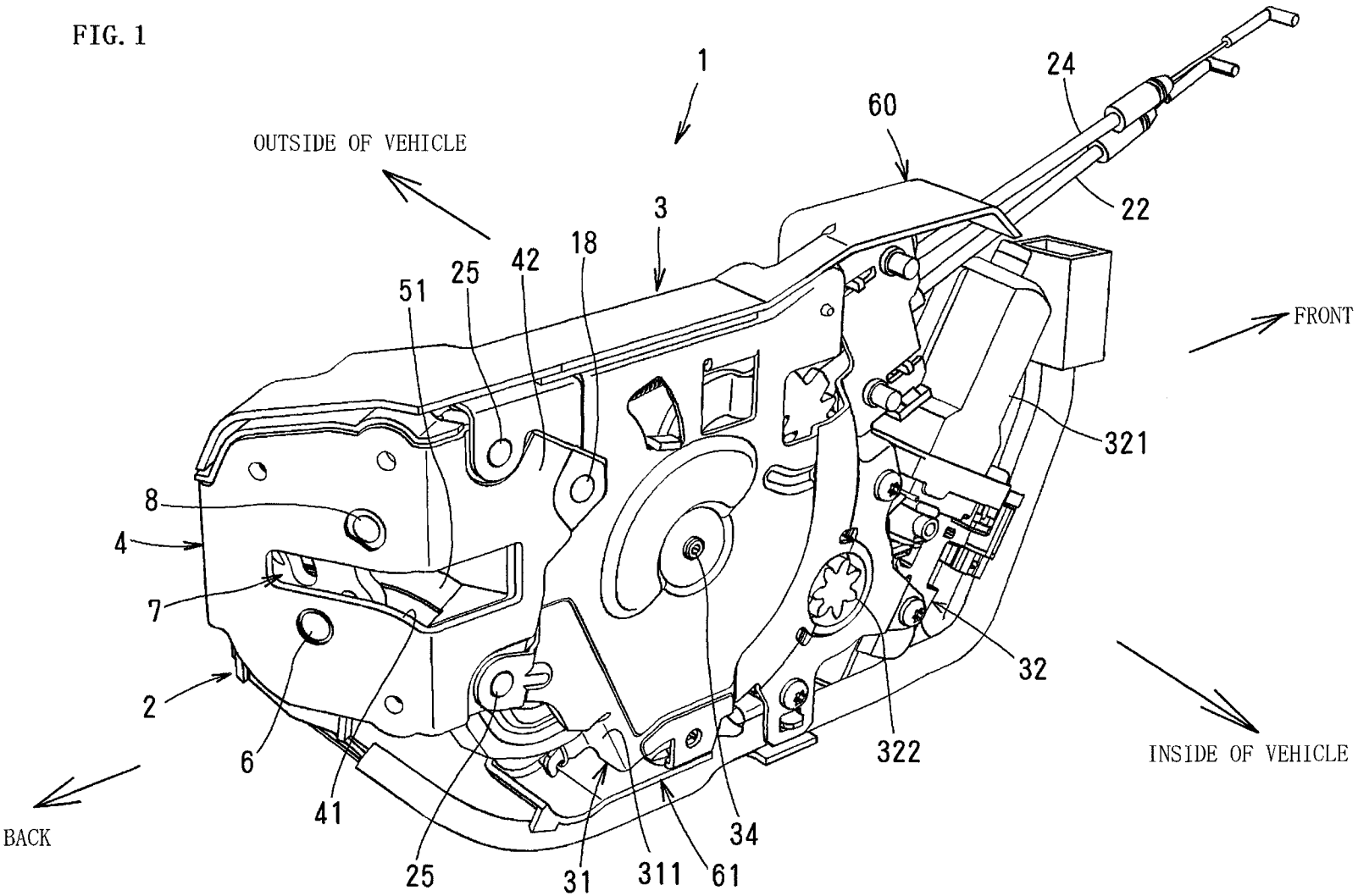
FIG. 1 is a perspective view of a door closer device according to the present invention seen from the inside of a vehicle.

In FIG. 1, a door closer 1 is attached to a rear portion of a sliding door of a vehicle and comprises a latch unit 2 which comprises a latch mechanism which engages with a striker S fixed to a vehicle body, and a closer unit 3 having a closer mechanism or a planetary gear mechanism 33 for actuating the latch mechanism from a half-latch state to a full-latch state to close the door from a improperly-closed state to a fully-closed state forcedly.

The tops of the latch unit 2 and closer unit 3 are covered with a synthetic-resin top cover 20 to prevent rainwater and dust from flowing in. The bottom of the closer unit 3 is covered with a bottom cover 61. The face of the planetary gear mechanism 33 of the closer unit 3 toward the outside of the vehicle is covered with a side wall 601 of the top cover 60 and a side wall 611 of the bottom cover 61.

First, the latch unit 2 will be described.

Figure 2:
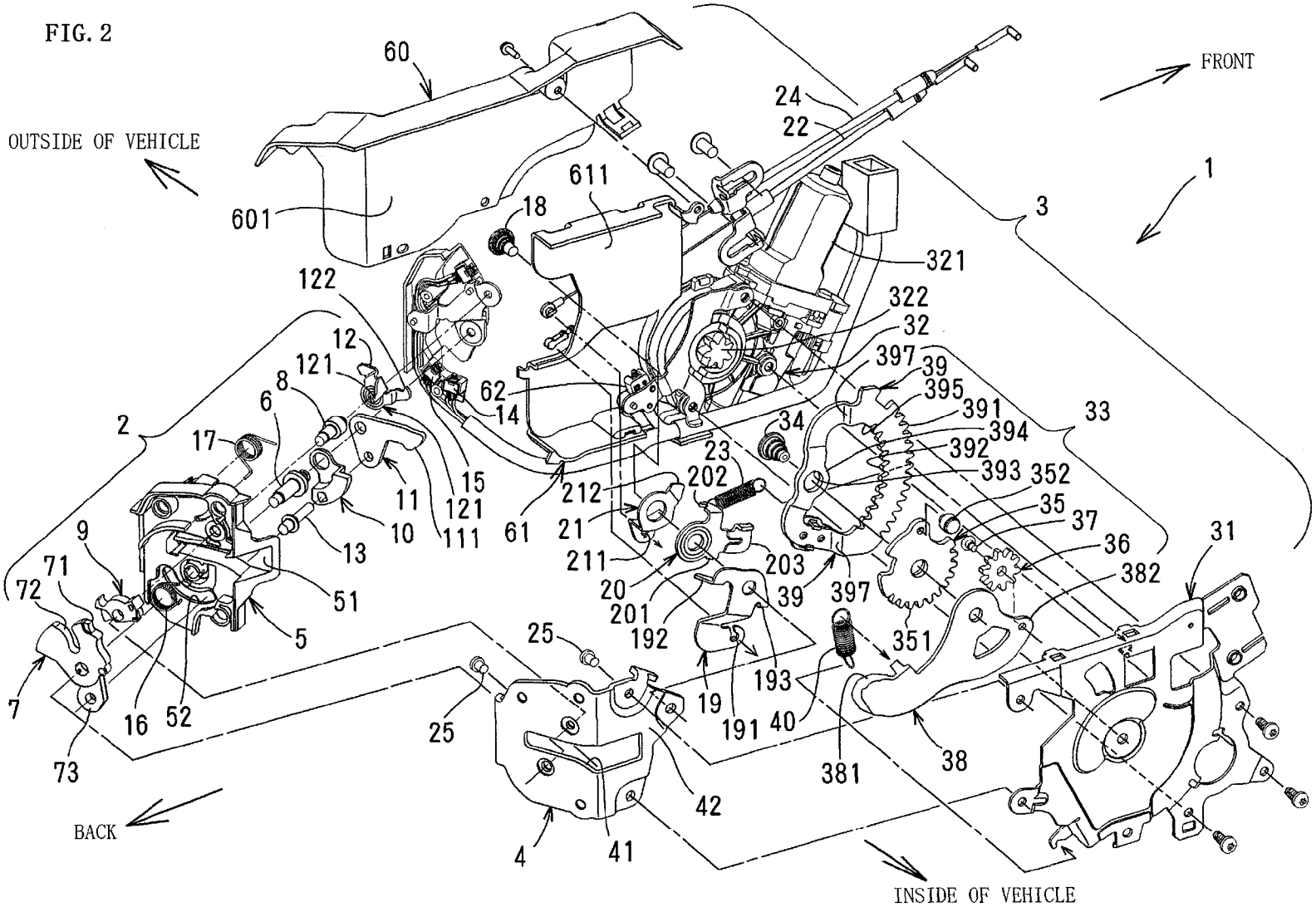
FIG. 2 is an exploded perspective view of the same seen from the inside of the vehicle.
Figure 3:
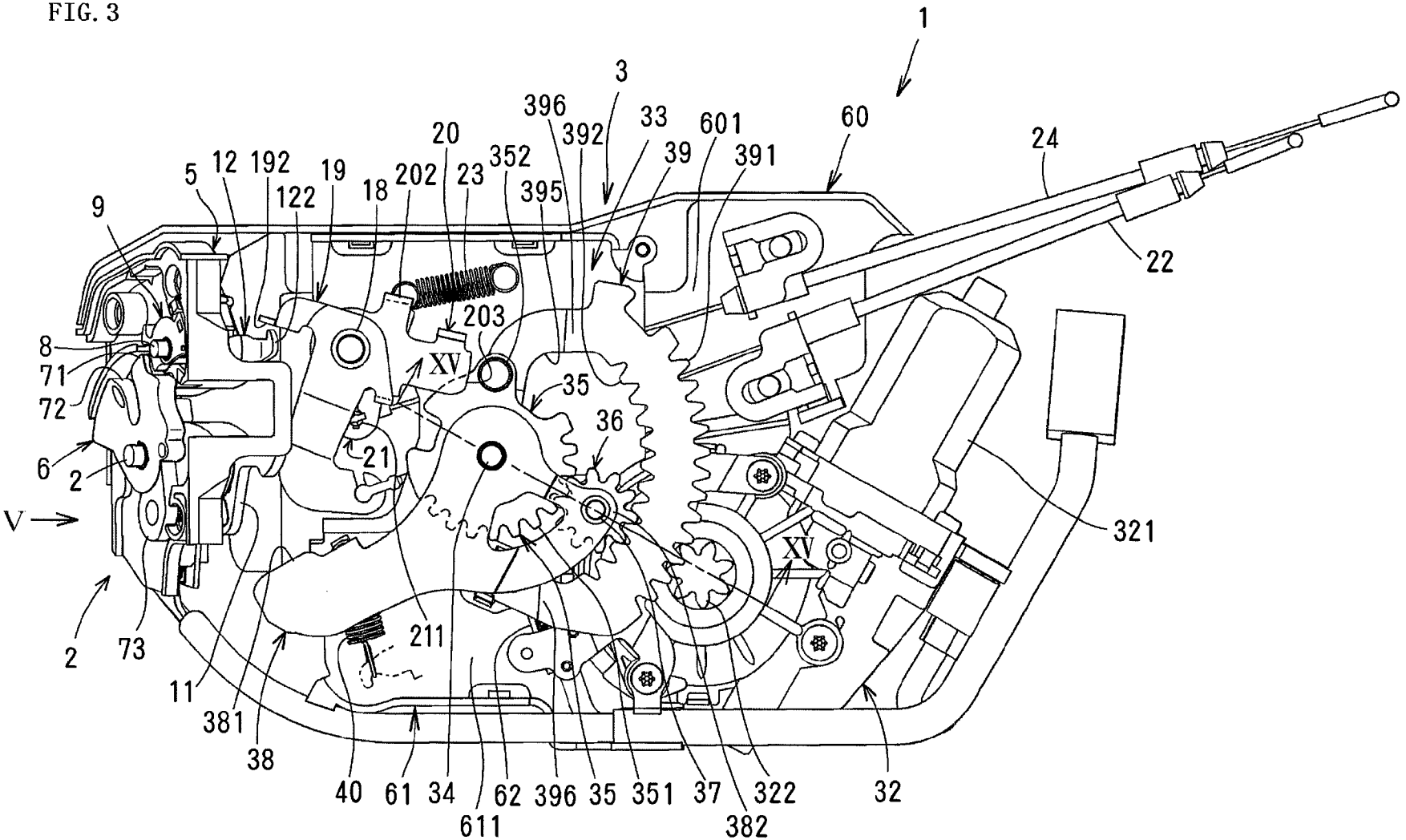
FIG. 3 is a front elevational view which illustrates the inside of the door closer device seen from the inside of the vehicle.
Figure 4:
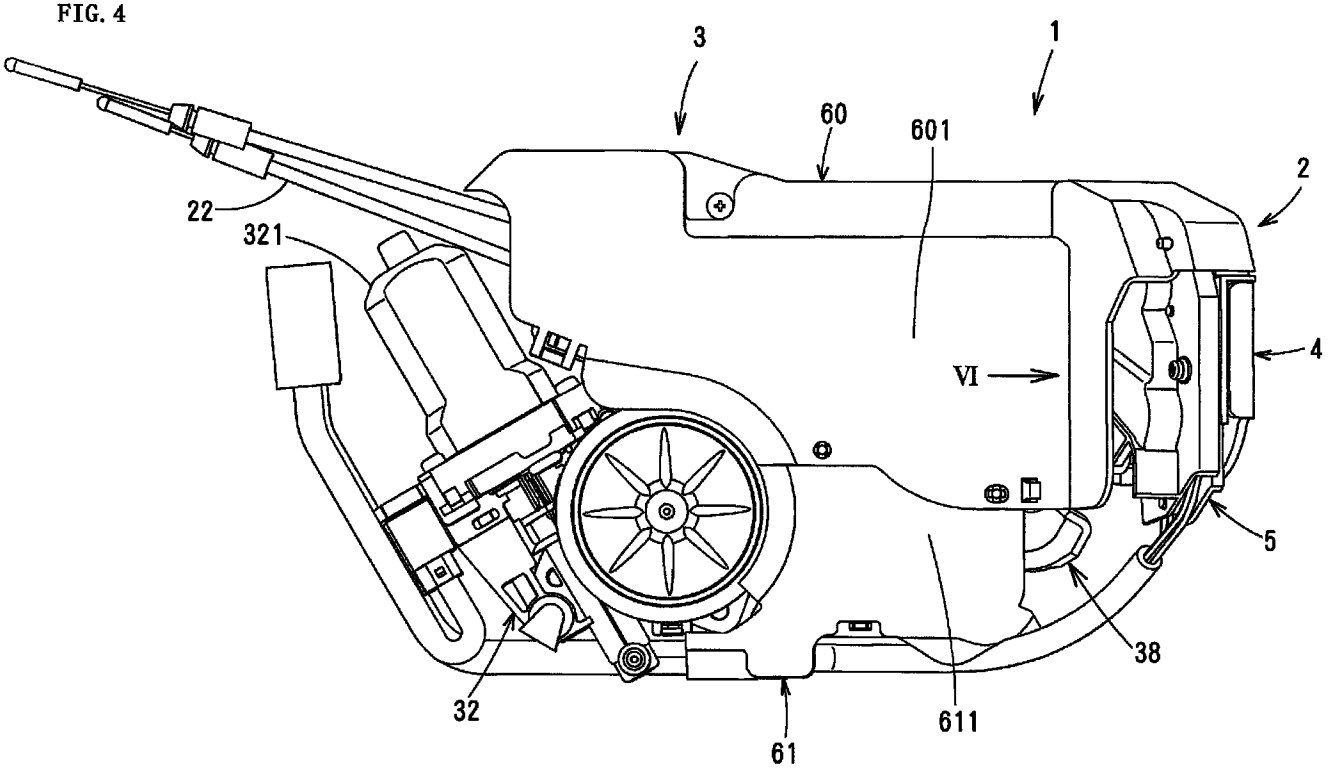
FIG. 4 is a back elevational view of the door closer device seen from the outside of the vehicle.
Figure 5:
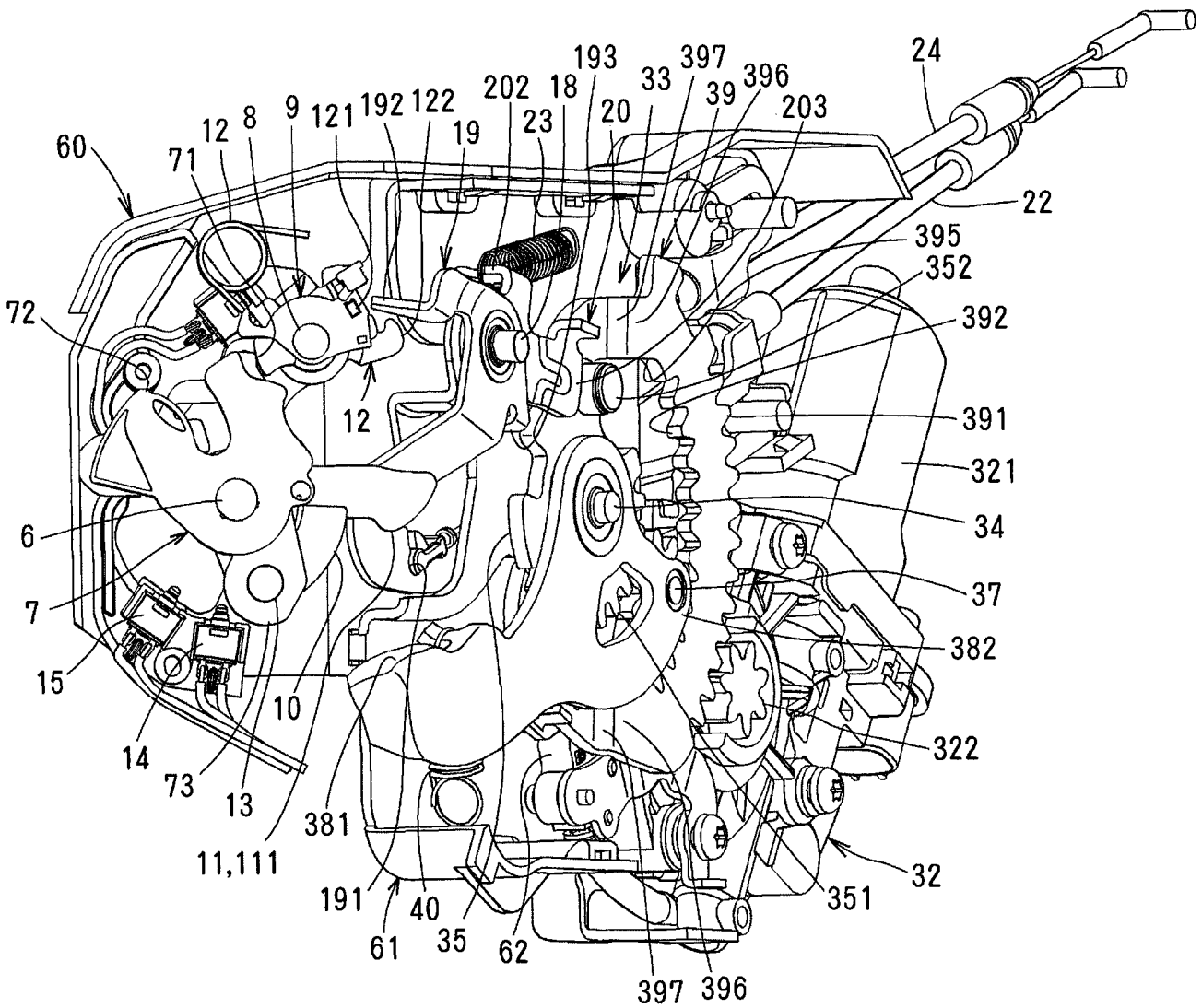
FIG. 5 is a rear side view of the door closer device seen from an arrow V in FIG. 3.

In FIGS. 1 to 6, the latch unit 2 comprises a synthetic-resin housing 5 closed with an L-shaped cover plate 4 in which the surface mounted to the door is made of metal. In the housing 5, the latch mechanism is disposed. In FIGS. 3 and 5, in order to illustrate the latch unit 2 and closer unit 3 more clearly, a cover plate 4 of the latch unit 2 and a base plate 31 of the closer unit 3 are omitted.

The latch mechanism includes a latch 7 pivotally mounted via a latch shaft 6 extending longitudinally of the vehicle to engage with the striker S; and a ratchet 9 pivotally mounted via a ratchet shaft 8 extending longitudinally of the vehicle to selectively engage with a full-latch engagement portion 71 or a half-latch engagement portion 72 provided on the outer periphery of the latch 7.

In the cover plate 4 and housing 5 of the latch unit 2, there are provided striker-entering grooves 41,51 respectively which are open so that the striker S comes in from the inside of the vehicle. The grooves 41,51 extend transversely of the vehicle.

Figure 9:
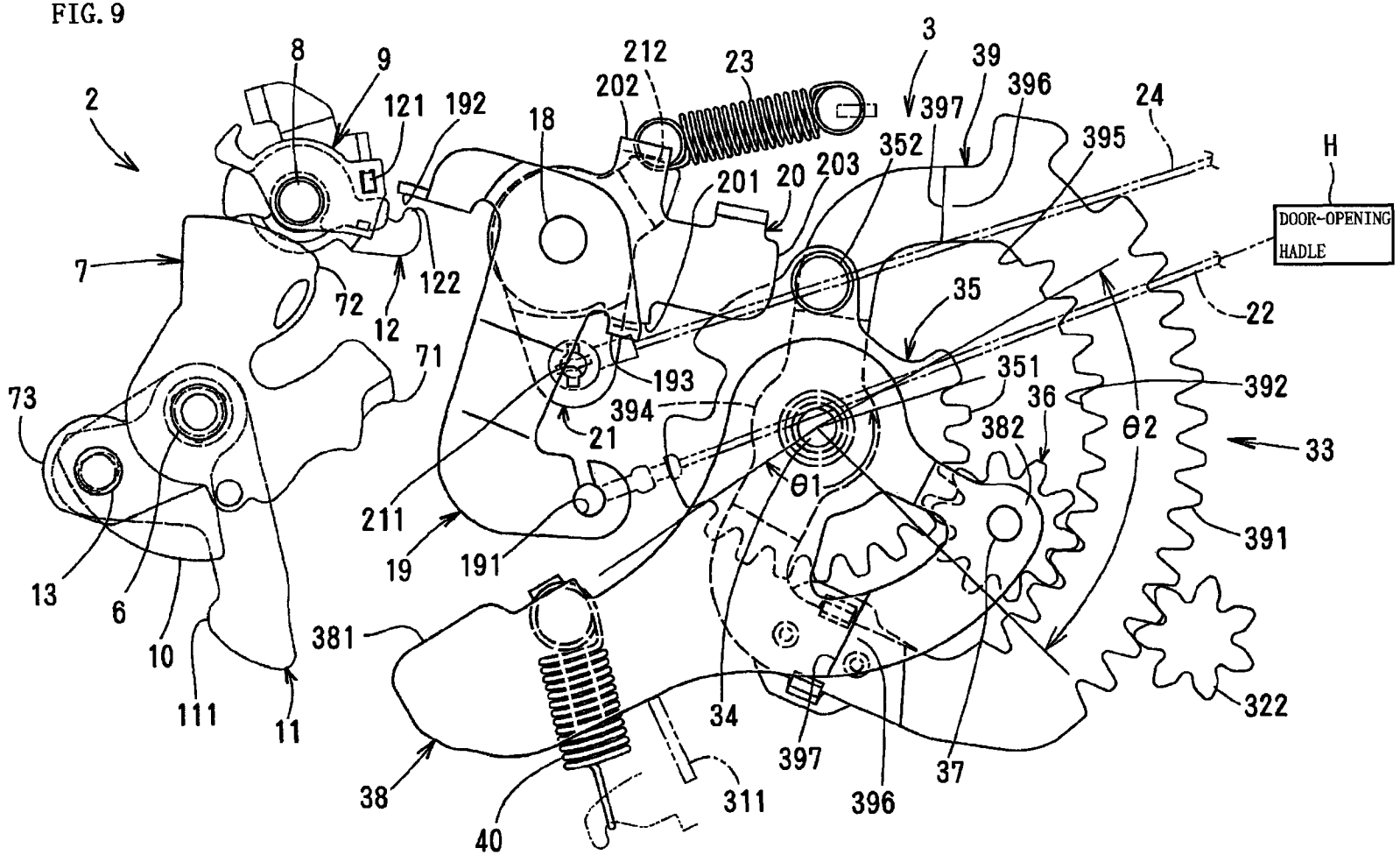
FIG. 9 is a front elevational view of the door closer device in an open state.
Figure 10:
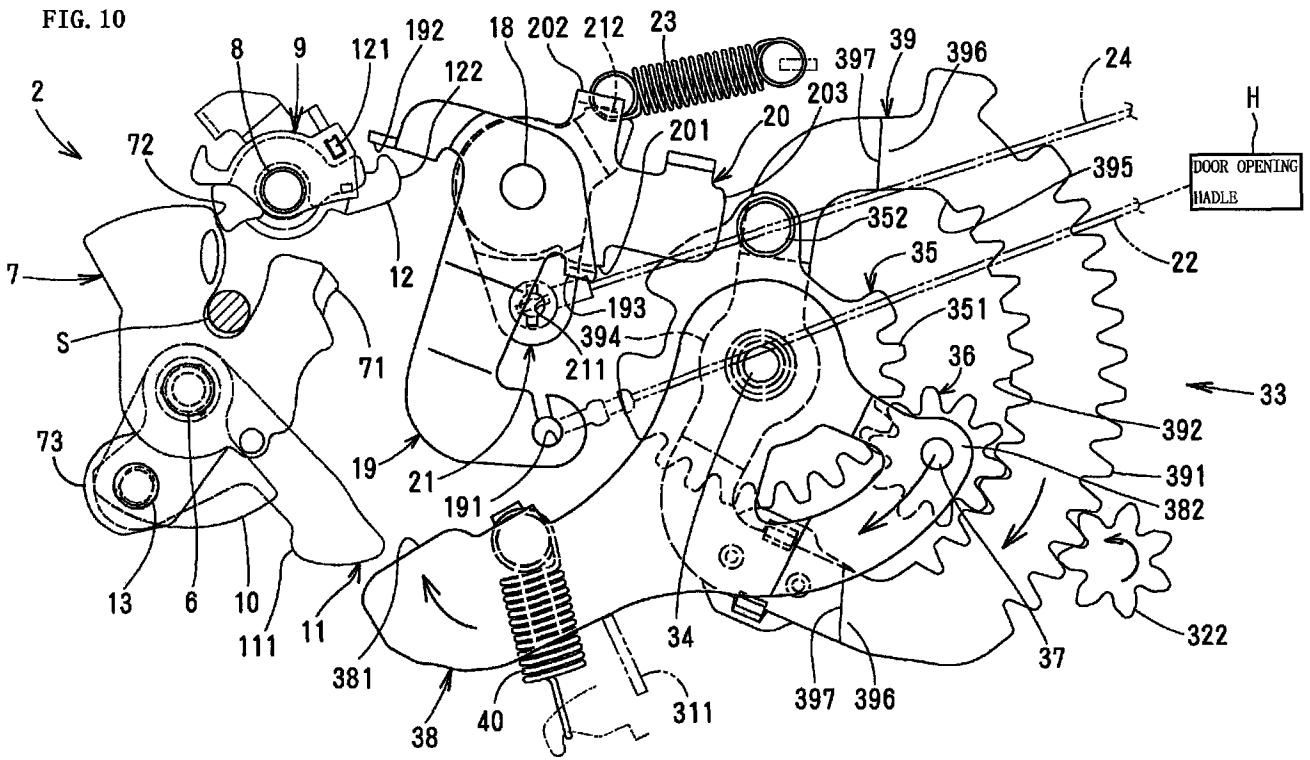
FIG. 10 is a front elevational view of the door closer device in a half-latch state.
Figure 11:
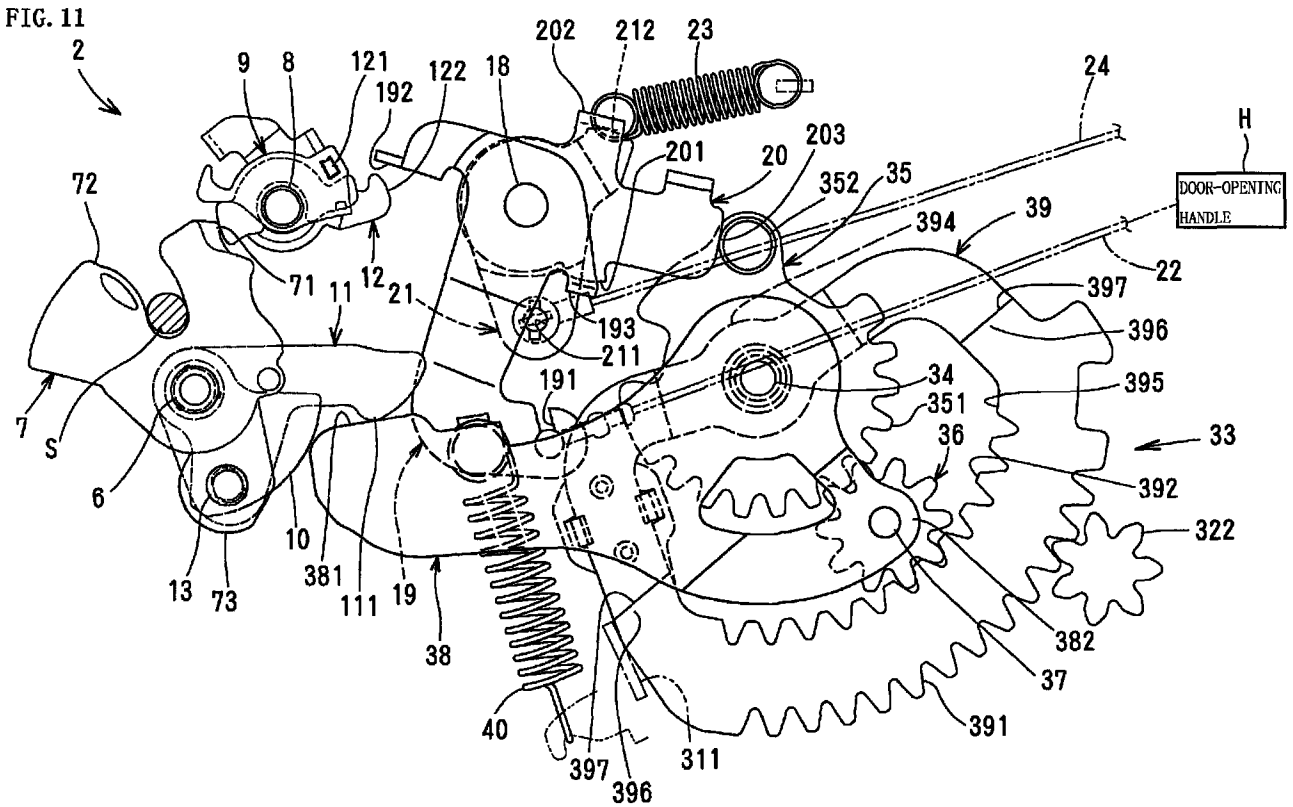
FIG. 11 is a front elevational view of the door closer device in a closing state.
Figure 12:
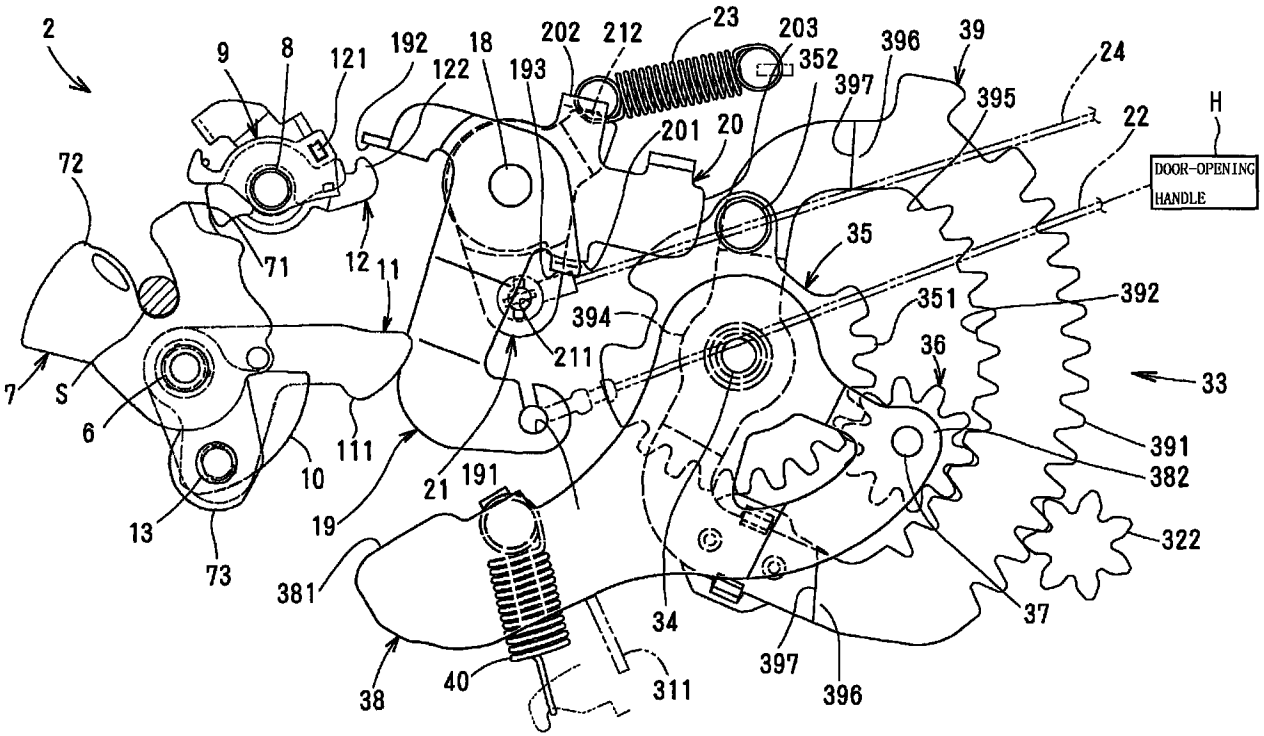
FIG. 12 is a front elevational view of the door closer device in a full-latch state.

The latch 7 turns from an open position in FIG. 9 in which the door is released from the striker S to a full-latch position in FIGS. 11 and 12 in which the latch 7 fully engages with the striker via a half-latch position in FIG. 10 in which the latch 7 slightly engages with the striker S against force of a spring 16 wound on the latch shaft 6 in FIG. 2 counterclockwise in a closing direction in FIG. 9. In the following description, "open position", "half-latch position" and "full-latch position" of the latch 7 are described as "open state", "half-latch state" and "full-latch state" of the latch mechanism respectively, if necessary.

Figure 6:
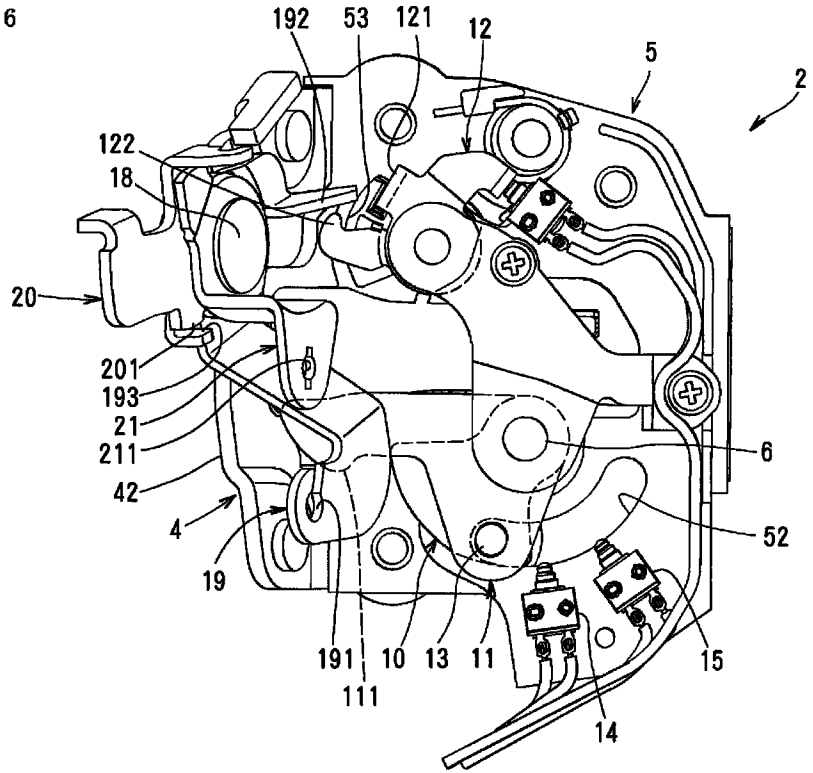
FIG. 6 is a front side view of a latch unit seen from an arrow VI in FIG. 4.
Figure 7:
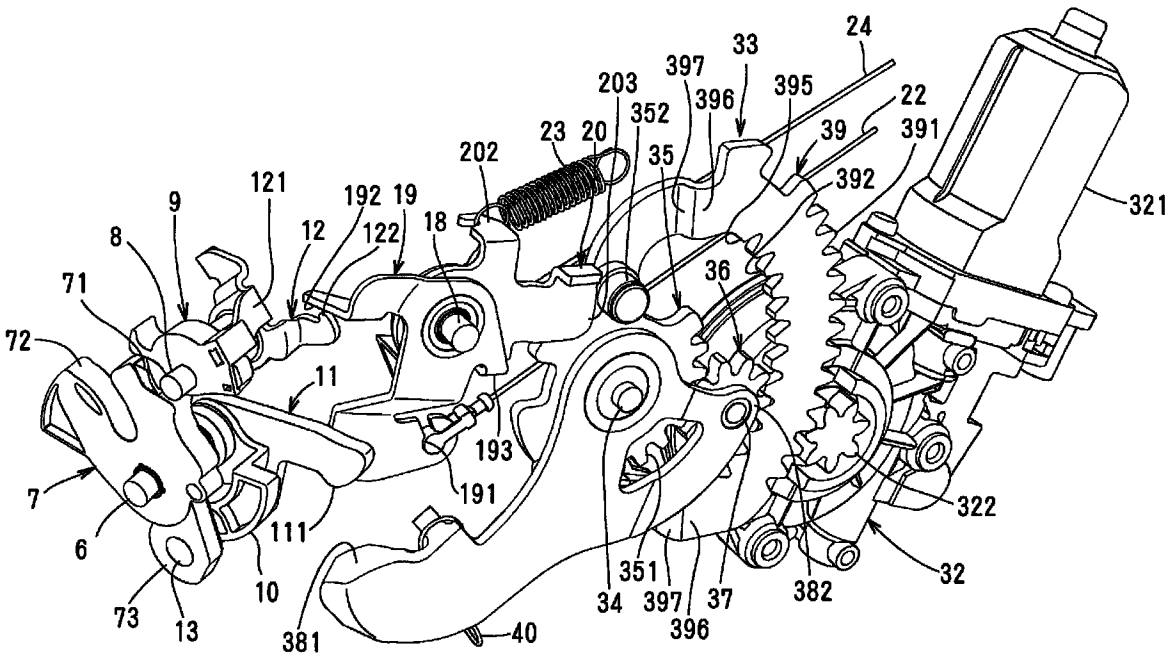
FIG. 7 is a perspective view of the door closer device seen from the inside of the vehicle.
Figure 8:
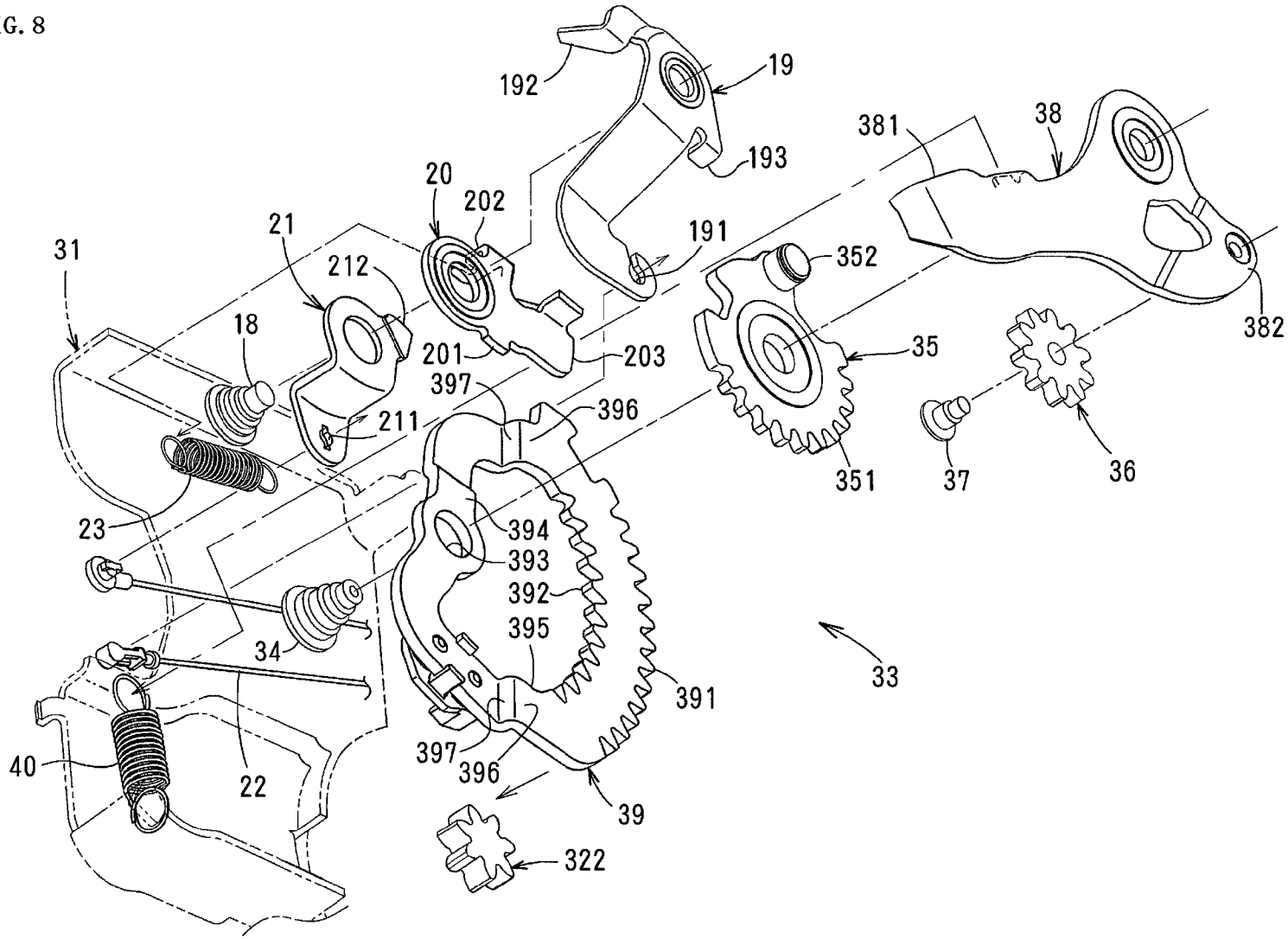
FIG. 8 is a perspective view of the door closer device seen from the outside of the vehicle.

In FIG. 6, on the front surface of the housing 5, a detecting lever 10 and a latch lever 11 are pivotally mounted about the latch shaft 6 to turn together with the latch 7, and an opening lever 12 is pivotally mounted about the ratchet shaft 8 to turn together with the ratchet 8.

The latch lever 11 which turns with the latch 7 points downward in FIG. 9 when the latch 7 is in the open position; it points obliquely forward and downward in FIG. 10; and forward when the latch 7 is in the half-latch position; and it points forward in FIG. 11 when the latch 7 is in the full-latch position. When the latch 7 is in the open position, a working portion 111 at the end of the latch lever 111 is out of a moving path of a closing portion 381 of a closing lever 38 as below and comes in the moving path of the closing portion 381 when the latch 7 turns to the half-latch position.

A connecting shaft 13 is fixed to the detecting lever 10 and latch lever 11. The connecting shaft 13 goes through an arcuate hole 52 around the latch shaft 6 and is fixed to an arm 73 of the latch 7, thereby allowing the detecting lever 10, latch lever 11 and latch 7 to turn together.

A first arm 121 of the opening lever 12 is disposed through an arcuate hole 53 of the housing 5 around the ratchet shaft 8 to engage with the ratchet 9. Hence, the opening lever 12 turns with the ratchet 9.

The half-latch position and full-latch position of the latch 7 are detected by a half-latch detecting switch 14 and a full-latch detecting switch 15 on the front surface of the housing 5. A detected signal is fed into a control circuit device (not shown) so as to trigger stop and drive of a motor 321 of the closer unit 2.

The ratchet 9 is forced with the opening lever 12 anytime by a spring 17 provided on the front surface of the housing 5 counterclockwise in an engagement direction in FIGS. 9 to 14. The ratchet 9 is in contact with the outer periphery of the latch 7 when the latch 7 is in the open position in FIG. 9, and the ratchet 9 engages with a half-latch engagement portion 72 of the latch 7 when the latch 7 is in the half-latch position in FIG. 10, thereby preventing the latch 7 from turning clockwise in FIG. 10 in an opening direction. When the latch 7 is in the full-latch position in FIG. 11, the ratchet 9 engages with a full-latch engagement portion 71 of the latch 7 thereby preventing the latch 7 from turning from the full-latch position in the opening direction.

When the ratchet 9 engages with the full-latch engagement portion 71 or half-latch engagement portion 72 of the latch 7, a door-opening handle H on the outside or inside of the vehicle is operated to open the door, and the ratchet 9 turns with a handle-connecting lever 19 (later described) against the spring 17, so that the ratchet 9 moves to a canceling position in FIGS. 13 and 14 out of the full-latch engagement portion 71 or half-latch engagement portion 72 thereby enabling the door to open.

The handle-connecting lever 19, a blocking lever 20 and an emergency lever 21 are pivotally mounted to a support surface 42 of the cover plate 4 via a pivot shaft 18 extending transversely of the vehicle.

A lower connecting portion 191 of the handle-connecting lever 19 is connected to the rear end of a connecting member 22 formed by a Bowden cable extending longitudinally of the vehicle in the door, so that the handle-connecting lever 19 is connected to the door-opening handle H via the connecting member 22. Thus, when the door-opening handle H is operated to open the door, the handle-connecting lever 19 turns against the spring 23 from a neutral position in FIGS. 9 to 12 counterclockwise in the releasing direction and turns to the canceling position in FIGS. 13 and 14. When the handle-connecting lever 19 turns to the canceling position, a releasing portion 192 at the rear end of the handle-connecting lever 19 pushes down the upper end of the second arm 122 of the opening lever 12, so that the ratchet 9 turns in the canceling direction via the opening lever 12 to allow the ratchet 9 to disengage from the full-latch engagement portion 71 or half-latch engagement portion 72 of the latch 7. Hence, the door can be opened.

The handle-connecting lever 19 is connected to the door-opening handle H via a locking/unlocking mechanism for turning an unlocking state for validating the door-opening operation of the door-opening handle H and a locking state for invalidating the door-opening operation. Thus, the handle-connecting lever 19 turns in the canceling direction by operating the door-opening handle H when the locking/unlocking mechanism is in an unlocking state. When the locking/unlocking mechanism is in the locking state, the handle-connecting lever 19 still remains in the neutral position, but does not turn in the canceling direction even if the door-opening handle is operated to open the door.

The blocking lever 20 is held in a blocking position where a blocking portion 203 at the end of an arm extends forward. When the handle-connecting lever 19 turns in the canceling direction to move to the canceling position, a bent portion 193 of the handle-connecting lever 19 comes in contact with a contact portion 201 to allow the blocking lever 20 to turn to the canceling position to which the blocking lever 20 turns counterclockwise at a certain angle as shown in FIGS. 13 and 14.

When the blocking lever 203 is held in the blocking position, the blocking portion 203 prevents a sun gear 35 (later described) of the planetary gear mechanism from turning counterclockwise. The blocking lever 203 moves to the canceling position to allow the sun gear 35 to turn counterclockwise. Thus, the blocking lever 20 is in the blocking position to enable reduced rotation of the planetary gear mechanism to be transmitted to the latch 7, and the blocking lever 20 is in the canceling position to enable reduced rotation of the planetary gear mechanism to stop thereby making it impossible to be transmitted to the latch 7.

A coupling member 211 at the lower part of the emergency lever 21 is coupled to the rear end of the connecting member 24 which extends longitudinally of the vehicle in the door. Hence, the emergency lever 21 is connected to the door-opening handle H or an emergency handle directly or via another lever, not via the locking/unlocking mechanism. Whether the locking/unlocking mechanism is in the unlocking state or locking state, the emergency lever 21 turns in the releasing direction by door-opening operation of the door-opening handle H.

When the emergency lever 21 turns in the releasing direction, a contact portion 212 at the upper end of the emergency lever 21 comes in contact with a bent portion 202 of the blocking lever 20 to allow the blocking lever 20 to turn in the releasing direction against force of the spring 23. In this case, the handle-connecting lever 19 is held in a neutral position to make it impossible for the ratchet 9 to turn in the releasing direction.

Then, the closer unit 3 will be described.

The closer unit 3 comprises a metal base plate 31 fixed on a support surface 42 of the cover plate 4 of the latch unit 2 with upper and lower rivets 25; a drive unit 32 disposed at the front part of the surface of the base plate 31 facing the outside of the vehicle, including a motor 321 and a reduction gear for slowing down rotation of the motor 321: and the planetary gear mechanism 33 disposed in the middle (between the latch 7 and drive unit 32 of the latch unit 2) of the surface of the base plate 31 facing the outside of the vehicle. The mechanism 33 meshes with an output gear 322 which rotates around an axis extending transversely of the vehicle and feeds rotation of the motor 321 thereby further slowing down the rotation of the output gear 322.

The planetary gear mechanism 33 comprises the structure for feeding a force for moving the latch mechanism of the latch unit 2 or the latch 7 from the half-latch state to the full-latch state, and comprises the sun gear 35 pivotally mounted via a pivot shaft 34 extending transversely of the vehicle; a single planetary gear 36 which meshes with the sun gear 35 to orbit the sun gear 35 while rotating on its own axis; a closing lever 38 which is pivotally mounted via the pivot shaft 34 and has a shaft 37 on which the planetary gear 36 is pivotally mounted; and a sector gear 39 pivotally mounted via the pivot shaft 34 and having external teeth 391 which mesh with a pinion 322 and internal teeth 392 which mesh with the planetary gear 36. The shaft 7 is disposed transversely of the vehicle.

In FIG. 9, the sun gear 35 has external teeth 351 on an arc given by a central angle θ1 for about 170 degrees. The external teeth 351 mesh with the planetary gear 36. On the upper part of the rotary surface without external teeth is formed a cylindrical contact portion 352 which projects toward the inside of the vehicle.

When the blocking lever 20 at the back of the sun gear 35 is in the blocking position, for example, in FIGS. 9 to 12, the blocking portion 203 of the blocking lever 20 comes in a moving path of the contact portion 352. The contact portion 352 moves counterclockwise and comes in contact with the blocking portion 203 thereby blocking the sun gear 35 from turning counterclockwise. When the blocking lever 20 is in the canceling position, for example, in FIGS. 13 and 14, the blocking portion 203 of the blocking lever 20 goes out of the moving path of the contact portion 352 to allow the sun gear 35 to turn counterclockwise freely.

When the planetary gear mechanism 33 does not work or is in the neutral state, the sun gear 35 is set such that the contact portion 352 is the highest and the external teeth 351 are at the lower position.

In this embodiment, the external teeth 351 are formed on the outer circumference over 170 degrees of a central angle of the sun gear 35. The present invention is not limited to the embodiment, but the central angle of the sun gear 35 may range from 90 to 180 degrees.

The closing lever 38 comprises a closing portion 381 which can come in contact with the working portion 111 of the latch lever 11 at one end closer to the latch 7 of the latch unit 34 than the pivot shaft 34, and a pivot portion 382 for pivotally mounting the planetary gear 36 via the shaft 37 at the other end closer to the pivot shaft 34.

In the neutral state of the planetary gear mechanism 33, the closing lever 38 is forced counterclockwise by a spring 40 one end of which engages with the closing lever 38, the other end of the spring 40 engaging with the base plate 31 to allow the closing lever 38 to be in contact with a stopper portion 311 of the base plate 31, so that a neutral position is set in which the closing portion 381 is gradually directed rearward and downward and the pivot portion 382 is gradually directed forward and downward to face the output gear 322. Hence, when the closing lever 38 is in the neutral position, the external teeth 391 and the internal teeth 392 of the sector gear 39 are held between the planetary gear 36 and the output gear 322 which face each other. When the planetary gear mechanism 33 is the neutral state, the external teeth 391 and the internal teeth 392 of the sector gear 39 are held between the planetary gear 36 and the output gear 322 thereby preventing the sector gear 39 from loosening.

In FIG. 9, the sector gear 39 provides the external teeth 391 on the outer circumference and the internal teeth 392 on the inner circumference of a fan of 80 degrees as a central angle θ2 and comprises a support portion 394 having an axial hole 393 and an opening 395 in which the planetary gear 36 engages with the internal teeth 392 between a support portion 394 and the internal teeth 392. The planetary gear 36 rotates on its own axis and orbits within the opening 395.

In the neutral state of the planetary gear mechanism 33, the sector gear 39 is set in a neutral position at a side opposite the latch 7 of the latch unit 7. The neutral position of the sector gear 39 is detected by a detecting switch 41 below the sector gear 39.

Figure 15:
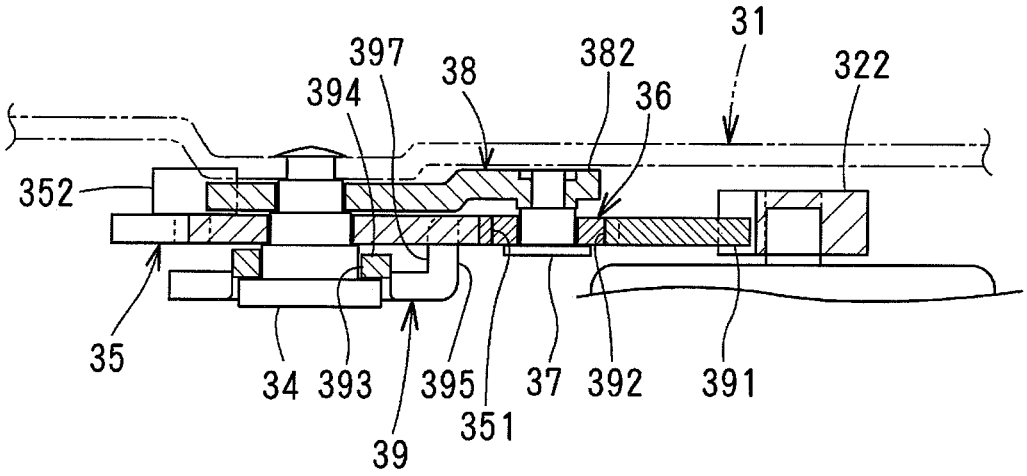
FIG. 15 is an enlarged sectional view taken along the line XV-XV in FIG. 3.

Upper and lower bridges 396 connects the support portion 394 of the sector gear 39 to the circumference on which the external teeth 391 and the internal teeth 392 are formed. On each of the upper and lower bridges 396, a step 397 is formed to become closer to the surface of the base plate 31 rather than the support portion 394. Thus, in FIG. 15, while the closing lever 38, sun gear 35 and sector gear 39 are axially overlapped on the base plate 31, the external teeth 351 of the sun gear 35, planetary gear 36, external teeth 391 and internal teeth 392 of the sector gear 39 and output gear 322 are arranged approximately in the same plane, thereby making axial thickness of the pivot shaft 34 of the planetary gear mechanism 33 thinner and providing smooth operation of the door closer device 1.

In FIG. 9, when the blocking lever 20 is held in the blocking position, the sector gear 39 turns clockwise about the pivot shaft 34 with normal rotation of the motor 321. Because the sun gear 35 is blocked by a blocking portion 203 of the blocking lever 20 from turning counterclockwise, the planetary gear 36 orbits clockwise while it turns on its own axis. Thus, the closing lever 38 turns slower than the sector gear 39 about the pivot shaft 34 clockwise or in a closing direction to a closed position where the closing portion 381 faces the top.

As mentioned above, in the planetary gear mechanism 33 of this embodiment, the external teeth 391 and internal teeth 392 are formed on the sector gear 39, and the single planetary gear 36 which engages with the internal teeth 392 is disposed within the opening 395 of the sector gear 39. The single planetary gear 36 turns on its own axis and orbits within the opening 395 on the inner circumference of the sector gear 39, thereby enabling the sector gear 39 and sun gear 35 to become smaller and thus enabling the planetary gear mechanism 33 to become smaller.

The planetary gear 36 is pivotally mounted directly on the pivot portion 382 of the closing lever 38, thereby reducing the number of parts and operating the closing lever 38 more smoothly.

Furthermore, when the sector gear 39 is in the neutral position, the external teeth **39*i* and internal teeth 392 are formed opposite the latch 7 with respect to the pivot shaft 34, and are not between the latch 7 and the pivot shaft 34 of the planetary gear mechanism 33, enabling the pivot shaft 34 of the planetary gear mechanism 33 to become closer to the latch 7 and thus enabling the door-closer device 1** to become smaller.

The operation of the door-closer device 1 according to the present invention will be described.

When the door is open, the latch unit 2 is in an open state in which the latch 7 is in an open position in FIG. 9, and the planetary gear mechanism 33 of the closer unit 3 is in the neutral state. The blocking lever 20 is in the blocking position. In this state, the contact portion 352 of the sun gear 35 faces the blocking portion 203 of the blocking lever 20 with a little gap.

When the door is closed to an improperly-closed position in the above state, the latch 7 turns to the half-latch position in FIG. 10, and the ratchet 9 engages with the half-latch engagement portion 72. The working portion 111 of the latch lever 11 comes within a moving path of the closing portion 381 of the closing lever 38 owing to the rotation of the latch 7 to a half-latch position.

When the half-latch detecting switch 14 detects that the latch 7 turns to the half-latch position, the motor 321 is controlled in normal rotation by the control circuit device. Thus, in FIG. 10, the output gear 322 turns counterclockwise as shown by an arrow, and the sector gear 39 turns clockwise as shown by an arrow about the pivot shaft 34. The blocking lever 20 is in a blocking position, and the blocking portion 203 is in a position capable of coming in contact with the contact portion 352 of the sun gear 35. Hence, after the sun gear 35 turns counterclockwise a little, the contact portion 352 comes in contact with the blocking portion 203 thereby blocking the sun gear 35 from turning counterclockwise. Thus, the planetary gear 36 orbits clockwise while the planetary gear 36 in the opening 395 of the sector gear 39 turns on its own axis clockwise.

With clockwise revolution of the planetary gear 36, the closing lever 38 turns clockwise or in a closing direction as shown by an arrow against the force of the spring 40. The closing portion 381 moves upward and raises the working portion 111 of the latch lever 11 to allow the latch lever 11 to turn counterclockwise. In FIG. 11, the latch 7 turns from the half-latch position to the full-latch position. The full-latch detecting switch 15 detects the full-latch position of the latch 7, so that the motor 321 is controlled for stop, and thereafter controlled to rotate reversely.

The motor 321 is controlled to rotate reversely, and the sector gear 39 turns reversely and rotates counterclockwise. The planetary gear 36 orbits counterclockwise while rotating on its own axis. The closing lever 38 turns reversely to return to the neutral position by counterclockwise force of the spring 40 with the orbital motion of the planetary gear 36. When the detecting switch 41 detects the neutral position of the closing lever 38, the motor 321 is controlled for stop and the planetary gear mechanism 33 returns to the neutral state before operation, so that a series of closing motions all end.

Canceling for stopping the closing action will be described.

On the way from the half-latch state in FIG. 10 to the full-latch state in FIG. 11, if foreign objects are held between the door and the entrance to stop the closing motion, the door-opening handle H is operated to open the door, and the motor 321 is controlled for stopping. Simultaneously, the handle-connecting lever 19 turns in a canceling direction via the connecting member 22, and the canceling portion 192 pushes down the second arm 122 of the opening lever 12, so that the ratchet 9 turns in the canceling direction with the opening lever 12.

Figure 13:
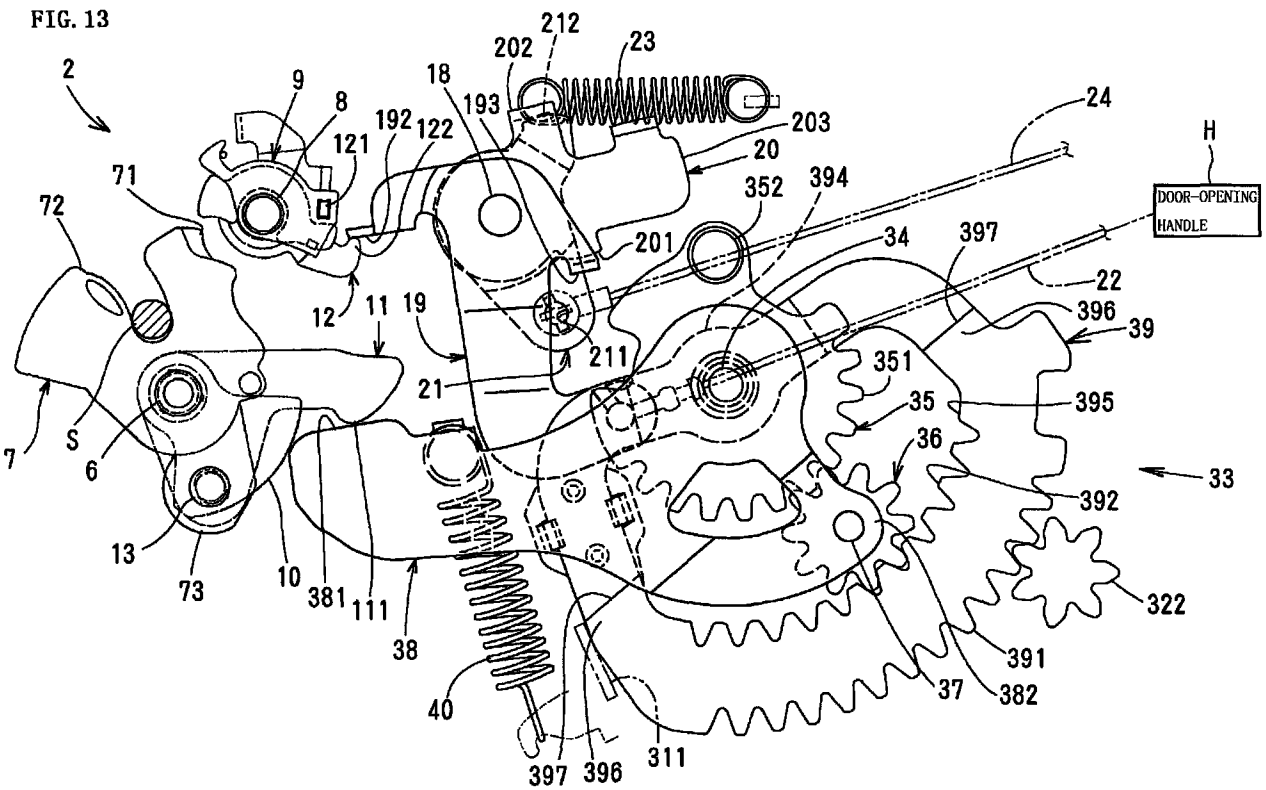
FIG. 13 is a front elevational view of the door closer device in a canceling state.
Figure 14:
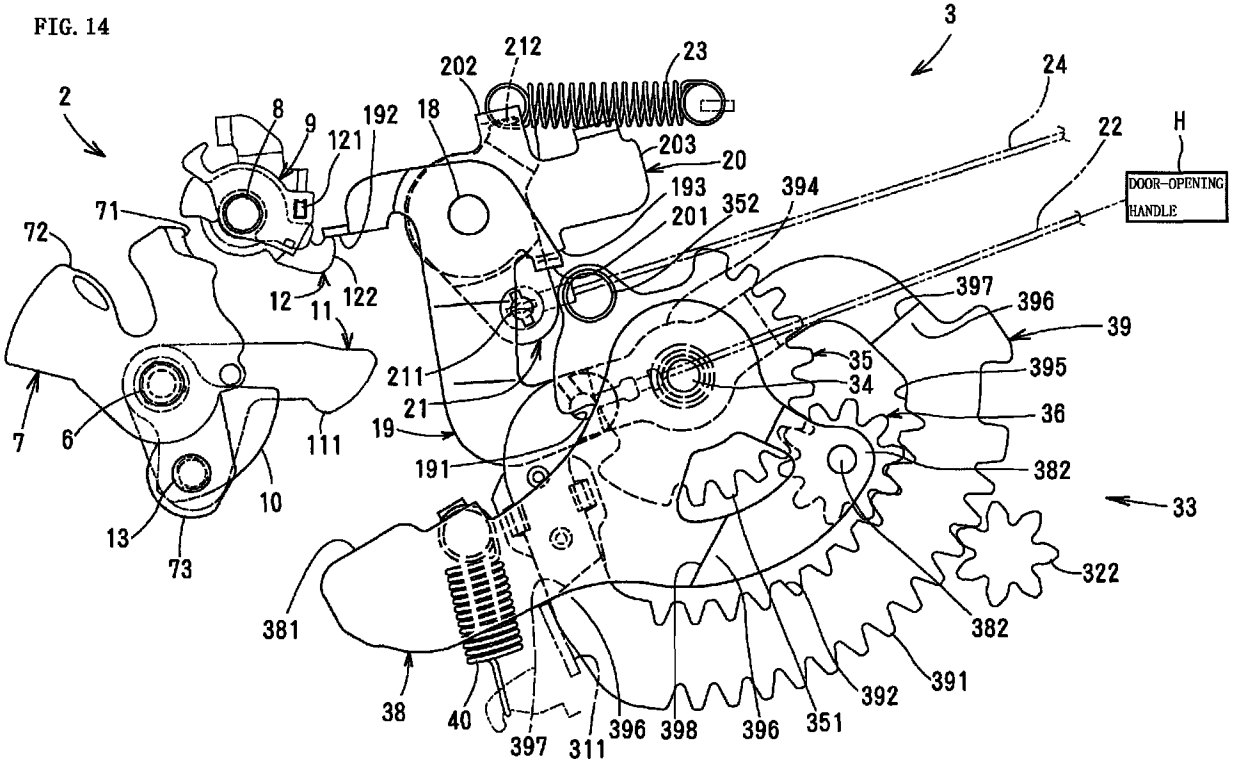
FIG. 14 is a front elevational view of the door closer device when canceling action ends.

In FIG. 13, when the ratchet 9 turns in the canceling direction, the ratchet 9 is held in the canceling position where the ratchet 9 is incapable of engaging with the full-latch engagement portion 71 and half-latch engagement portion 72 of the latch 7. Simultaneously, the bent portion 193 of the handle-connecting lever 19 comes in contact with the contact portion 201 of the blocking lever 20 to allow the blocking lever 20 to turn in the canceling position against the force of the spring 23 and to allow the blocking portion 203 to go out of the moving path of the contact portion 352 of the sun gear 35, thereby making the sun gear 35 turn freely counterclockwise. Hence, the transmission of reduced speed from the sector gear 39 to the planetary gear 36 is blocked, so that the closing lever 38 rotates reversely to the neutral position by the force of the spring 40 to enable the latch 7 to turn to the open position, so that the door can be opened.

The door is opened to stop the door-opening operation of the door-opening handle H, and the motor 321 is controlled reversely. The sector gear 39 turns to the neutral position, and the sun gear 35 returns to the neutral position with turning of the sector gear 39 and rotation of the planetary gear 36. A series of canceling motions end. Closing motion stops when the closing lever 38 is actuated, thereby preventing the foreign objects from being held between the door and vehicle body to improve safety.

In the canceling action, the emergency lever 21 turns in the releasing direction to turn the blocking lever 20 in the canceling position, so that the closing action can be stopped similarly to the above. However, in this case, the ratchet 9 does not turn in the releasing direction, so that the door cannot be opened.

The foregoing merely relates to embodiments of the invention. Without departing from the scope of claims, the following variations and modifications may be made:

1) The closing portion 381 of the closing lever 38 may be directly connected to the latch 7 without the latch lever 11.

2) The base plate 31 of the closer unit 2 may be fixed to the housing 5 directly or via another element instead of fixing to the cover plate 4 of the latch unit 2.

3) The blocking lever 20 may be omitted, and the sun gear 35 may be fixed to the pivot shaft 34 fixed to the base plate 31.

What is claimed is:

1. A door closer device moving a latch from a half-latch position to a full-latch position, the latch being capable of engaging with a striker, the door closer device comprising:

a base member;

a pivot shaft mounted to the base member;

a sun gear pivotally mounted to the base member via the pivot shaft;

a planetary gear that meshes with the sun gear to orbit the sun gear while rotating on its own axis;

a closing lever pivotally mounted to the base member via the pivot shaft and pivotally connected with the planetary gear;

a motor;

an output gear driven by the motor;

a sector gear pivotally mounted to the base member via the pivot shaft and having an external teeth that meshes with the output gear on an outer circumference and an internal teeth that meshes with the planetary gear on an inner circumference, the output gear driven by the motor rotating to allow the sector gear to turn thereby swinging the closing lever about the pivot shaft to move the latch from the half-latch position to the full-latch position; and a latch lever that turns together with the latch about a latch shaft, the closing lever comprising a closing portion at an end, the closing portion of the closing lever coming in direct contact with the latch lever to move the latch lever together with the latch thereby moving the latch from half-latch position to the full-latch position.

2. The door closer device of claim 1 wherein the sector gear comprises a support portion having an axial hole in which the pivot shaft is disposed; and an opening between the support portion and the internal teeth, the planetary gear being single and disposed in the opening to orbit while turning on its own axis.

3. The door closer device of claim 1 wherein the closing lever, the sun gear and the sector gear overlaps on the base member in order of the closing lever, the sun gear and the sector gear axially, the sector gear having a step by which the internal teeth is closer to a surface of the base member than a rotary surface of the support portion.

4. The door closer device of claim 1 wherein the sun gear has external teeth on an outer circumference.

5. A door closer device comprising:

a sun gear pivoting via a pivot shaft;

a planetary gear that meshes with the sun gear to orbit the sun gear while turning on its own axis;

a closing lever pivotally mounted via the pivot shaft and also pivotally mounted with the planetary gear via a shaft in parallel with the pivot shaft, the closing lever being related to a latch which can engage with a striker;

a motor;

an output gear that rotates around an axis in parallel with the pivot shaft by the motor;

a sector gear pivotally mounted via the pivot shaft and having on an outer circumference an external teeth meshing with the output gear and on an inner circumference an internal teeth meshing with the planetary gear, wherein rotation of the motor is transmitted to the sector gear via the output gear and the external teeth, and rotation of the sector gear is transmitted to the closing lever via the internal teeth and the planetary gear to allow the closing lever to move the latch from a half-latch position to a full-latch position; and a latch lever that turns together with the latch about a latch shaft, the closing lever comprising a closing portion at an end, the closing portion of the closing lever coming in direct contact with the latch lever to move the latch lever together with the latch thereby moving the latch from the half-latch position to the full-latch position.

6. A door closer device comprising:

a housing;

a latch pivotally mounted to the housing to allow the latch to move from a half-latch position where the latch slightly engages with a striker to a full-latch position where the latch fully engages with the striker;

a base member fixed to the housing directly or indirectly;

a motor disposed on the base member;

a pivot shaft on the base member;

a sun gear pivotally mounted to the base member via the pivot shaft;

a planetary gear that meshes with the sun gear to orbit the sun gear while turning on its own axis;

a closing lever pivotally mounted to the base member via the pivot shaft and pivotally mounted with the planetary gear, the closing lever comprising a closing portion related to the latch at a first end closer to the latch than the pivot shaft, and a pivot portion for pivoting the planetary gear at a second end farther from the latch with respect to the pivot shaft; and an output gear driven by the motor; and a sector gear pivotally mounted via the pivot shaft and comprising an external teeth which meshes with the output gear on an outer circumference farther from the latch with respect to the pivot shaft and an internal teeth which meshes with the planetary gear on an inner circumference, wherein the output gear makes the sector gear turn to allow the planetary gear to orbit while turning on its own axis thereby turning the closing lever about the pivot shaft, so that the latch moves from the half-latch position to the full-latch position by the closing lever; and a latch lever that turns together with the latch about a latch shaft, the closing portion of the closing lever coming in direct contact with the latch lever to move the latch lever together with the latch thereby moving the latch from the half-latch position to the full-latch position.

7. The door closer device of claim 6 wherein the closing lever is single.

8. The door closer device of claim 6 wherein the sun gear has external teeth on a circumference.

* * * * *